US006926421B2

(12) United States Patent
Huang

(10) Patent No.: US 6,926,421 B2
(45) Date of Patent: Aug. 9, 2005

(54) LIGHT EMITTING PEN ACTUATED BY PIVOTALLY ROTATING A CLIP

(76) Inventor: Ming Huang, 235 Chung-Ho, Box 8-24, Taipei (TW)

( * ) Notice: Subject to any disclaimer, the term of this patent is extended or adjusted under 35 U.S.C. 154(b) by 151 days.

(21) Appl. No.: 10/666,780

(22) Filed: Sep. 22, 2003

(65) Prior Publication Data

US 2005/0063178 A1 Mar. 24, 2005

(51) Int. Cl.[7] ..... B43K 29/10
(52) U.S. Cl. ..... 362/118; 362/579; 362/205
(58) Field of Search ..... 362/118, 115, 362/579, 204, 205, 206, 802; 200/60, 310, 573, 574

(56) References Cited

U.S. PATENT DOCUMENTS 2,277,866 A * 3/1942 Le Sage ..... 362/196
2,979,602 A * 4/1961 Barnett ..... 362/579
3,502,859 A * 3/1970 Kochan ..... 362/579
4,408,263 A * 10/1983 Sternlicht ..... 362/189
4,563,728 A * 1/1986 Bruggeman et al. ..... 362/206
5,050,053 A * 9/1991 McDermott ..... 362/204

* cited by examiner

*Primary Examiner*—John Anthony Ward
*Assistant Examiner*—Bao Q. Truong

(57) ABSTRACT

A light emitting pen actuated by pivotally rotating a clip includes an upper pen tube and a lower pen tube. A base at an upper end of the upper pen tube has a slot. The clip is buckled into the slot. The clip is an eccentric block. The eccentric block is pivotally installed in the slot by using a stud. A top stud of the switch button protrudes from a central round hole of the base. A top of the top stud resists against the eccentric block of the clip. When the clip pivotally rotates upwards, the switch button descends to contact the light emitting device to light up. The light emitting device moves downward to cause the refill moves downwards. Then a tip of the refill protrudes out of the pen tube. When the clip pivotally rotates, the light emitting body does not light up and the tip embeds into the pen tube.

6 Claims, 3 Drawing Sheets

LIGHT EMITTING PEN ACTUATED BY PIVOTALLY ROTATING A CLIP

FIELD OF THE INVENTION

The present invention relates to light emitting pens, and particularly to a light emitting pen actuated by pivotally rotating a clip.

BACKGROUND OF THE INVENTION

Currently, power switches of light emitting pens include switch button, rotation switch, and touch press. The switch button pen is that a pressable switch is installed at a top end or near an upper end of the pen tube, and the pressable switch can be pressed by fingers. After pressing the switch button, the light emitting pen lights up. In the rotation switch light emitting pen, if the upper pen tube is rotated, then the pen lights up. In the touch press light emitting pen, when the tip of the refill touches a surface of a paper, the refill rises to trigger a light emitting body to light up.

In above mentioned prior art, the refill and the light emitting body are independent. That is to say, the lighting up of the light emitting body has no relation to the movement of the tip with respect to the refill. The light up of the light emitting body is controlled directly by a power switch. The movement of the pen tip of the refill with respect to the refill is by pressing a hat portion at the top of the pen or rotating the pen tube. Thereby, the operations of the pen tip and the light emitting body are independent so that the operation is inconvenient. Thereby, there is an eager demand for a novel design which can improve the defect of the prior art.

SUMMARY OF THE INVENTION

Accordingly, the primary object of the present invention is to provide a light emitting pen actuated by pivotally rotating a clip. The pen comprises an upper pen tube and a lower pen tube. The upper pen tube includes a pen tube, a switch button in the pen tube, and a light emitting device in the pen tube and below the switch button. The lower pen tube includes cylinder, a refill in the cylinder, a conduit resisting against a bottom of the light emitting device for receiving the refill; and a resilient spring enclosing the refill.

A base is at an upper end of the upper pen tube. The base has a slot. One end portion of the clip is buckled into the slot; the end portion of the clip is an eccentric block. The eccentric block is pivotally installed in the slot by using a stud. A top stud of the switch button protrudes from a central round hole of the base. A top of the top stud resists against the eccentric block of the clip. When the clip pivotally rotates upwards, the eccentric block presses the top stud so that the switch button descends to contact the light emitting device to cause a light emitting body in the light emitting device lights up. Then, the light emitting device moves downward to cause the refill moves downwards. Then a tip of the refill protrudes out of the pen tube. When the clip is pivotally rotated, the light emitting body does not light up and the tip embeds into the pen tube.

The various objects and advantages of the present invention will be more readily understood from the following detailed description when read in conjunction with the appended drawing.

DETAILED DESCRIPTION OF THE PREFERRED EMBODIMENTS

Figure 1:
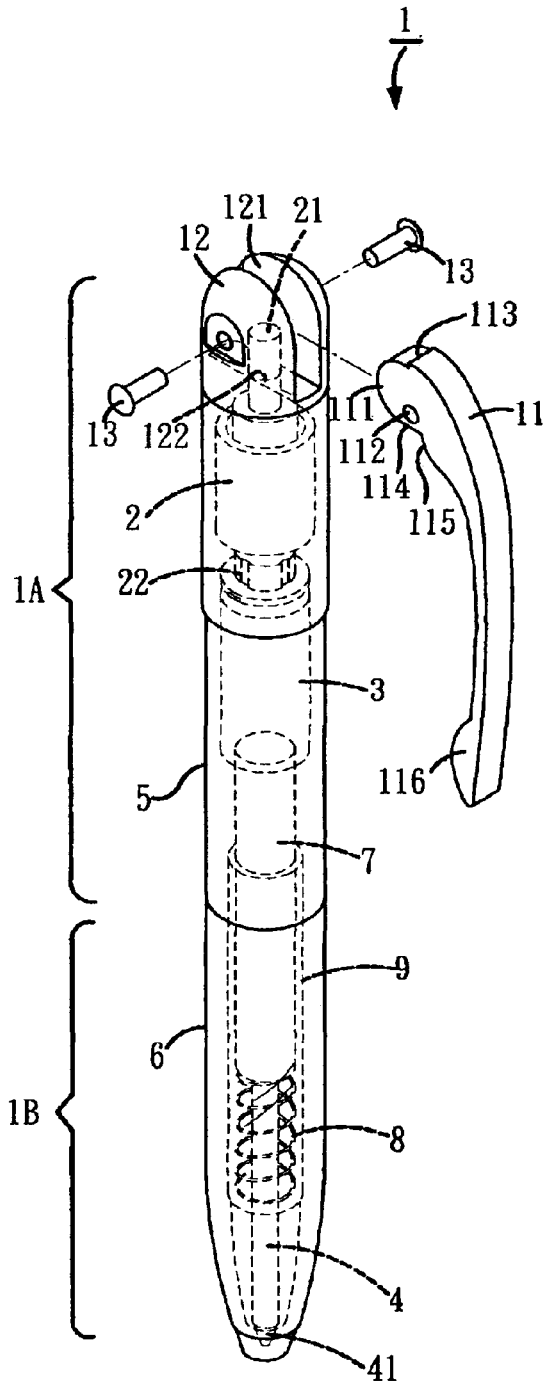
FIG. 1 is an exploded perspective view of the present invention.

Referring to FIG. 1, the exploded perspective view of the light emitting pen actuated by pivotally rotating a clip of the present invention is illustrated. In the drawing, the pen 1 of the present invention includes an upper pen tube 1A and a lower pen tube 1B. A light emitting pen actuated by pivotally rotating a clip is formed by assembling the upper pen tube 1A and lower pen tube 1B. The upper pen tube 1A includes a pen tube 5, a switch button 2 in the pen tube 5, and a light emitting device 3 in the pen tube 5 and below the switch button 2. The lower pen tube 1B is formed by a cylinder 6, a refill 4 in the cylinder 6, a conduit 7 in contact with a bottom of the light emitting device 3 and receiving a top portion of the refill 4; and a series of resilient springs below the refill 4. A refill 4 is integrally formed with the conduit 7. A liner tube 9 is installed in the pen tube 6. The refill 4, conduit 7, and resilient spring 8 are placed in the liner tube 9.

Figure 2:
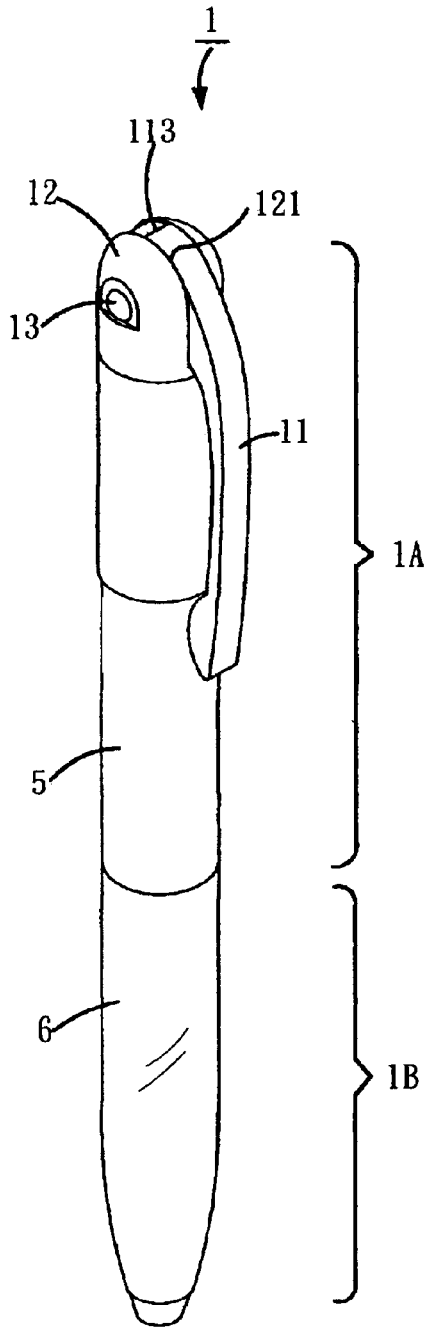
FIG. 2 is an assembled perspective view of the present invention.

The feature of the present invention will be described herein. An upper end of the pen tube 5 of the upper pen tube 1A has a base 12. The base 12 has a slot 121. A clip 11 is engaged to an end portion of the slot 121. The end portion of the clip 11 is an eccentric block 111. The eccentric block 111 is pivotally installed in the slot 121 by using a stud 13. A top stud 21 of the switch button 2 protrudes out of a central round hole 122 in the slot of the base 12. A top of the switch button 2 resists against the eccentric block 111. The structure after assembly is illustrated in FIG. 2.

Figure 3:
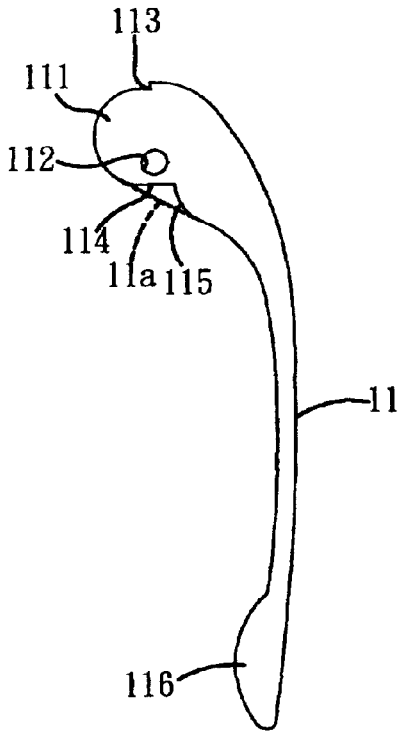
FIG. 3 shows one embodiment of the present invention.

In above description, the structure of the clip 3 is illustrated in FIG. 3. The clip 11 is a cambered arm. One end of the clip 11 is an eccentric block 111 and another end of the clip 11 is an ear portion 116 resisting against the outer wall of the pen tube 5. The eccentric block 111 is a semi-round block. A lower end of the eccentric block 111 has an eccentric axial hole 112 and an upper end of the eccentric block 111 has a trapezoidal shape recess 113. A bottom end of the eccentric block 111 has a flat surface 114 and a cambered stop wall 115 connected to the fuel flat surface 114. The flat surface 114 and the cambered stop wall 115 are formed as a triangular recess 11*a* (as the dashed line shown).

Moreover, the slot 121 of the base is received in the eccentric block 111. A stud 13 inserts into the eccentric axial hole 112 from two sides of the base 12 so as to combine the clip 11 with the base 12. Thereby, the clip 11 is able to rotate around the stud 13.

Figure 5:
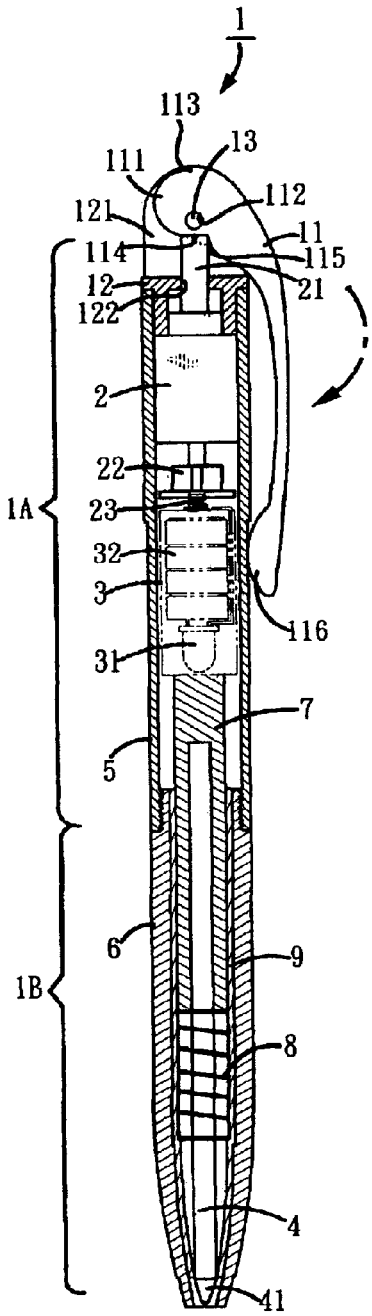
FIG. 5 is a schematic view showing that the clip of the present invention is rotated upwards.

Next, from the cross section view of FIG. 5, it is illustrated that the pen tube 5 of the upper pen tube 1A has sequentially a switch button 2, a liftable clutch shaft 22, a conductive spring 23 and a light emitting device 3 (installed with light emitting body 31 and battery set 32 therein), etc. Since the push and brake structure of the upper pen tube 1A is known in the prior art and thus the details will not described herein. It should be noted that a top stud 21 of the switch button 2 protrudes out of the central round hole 122 of the base 12. The top of the top stud 21 is in contact with the flat surface 114 of the eccentric block 111 as the clip 11 is clamped.

FIG. 5 shows a cross section view that the clip 11 dose not act. It is known from the drawing that when the switch button 2 is not pressed. By the pushing force of the conductive spring 23 and the resilient spring 8 or other expandable spring (not shown, it can enclose the top stud 23), the upper end of the top stud 21 resists against a flat surface 114 at the lower side of the eccentric block 111 so that the clip 11 can be retained at the opening of a pocket firmly.

Figure 4:
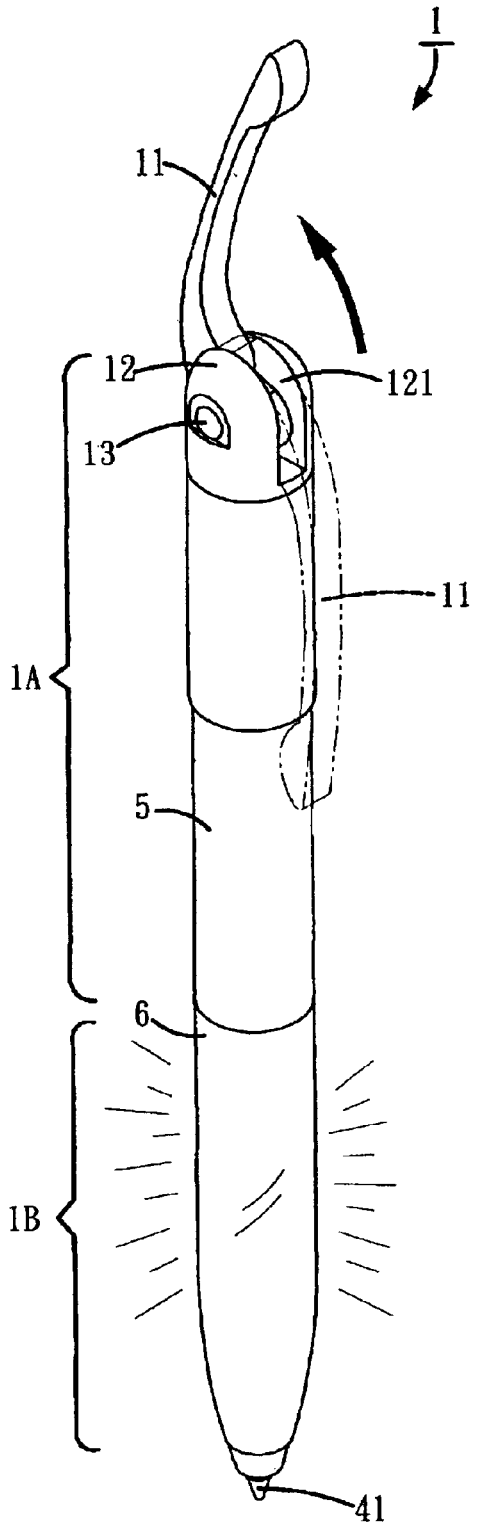
FIG. 4 is a schematic view showing that the clip of the present invention is in position.

Referring to FIG. 4, the schematic view of the present invention is illustrated. It is illustrated that when the clip 11 rotates upwards through 180 degrees, the lower pen tube 1B of the light emitting pen 1 will light up (the upper pen tube 1A does not light up). At the same time, the tip 41 of the refill 4 protrudes out of the cylinder 6. Therefore the user can use the pen at night.

Figure 6:
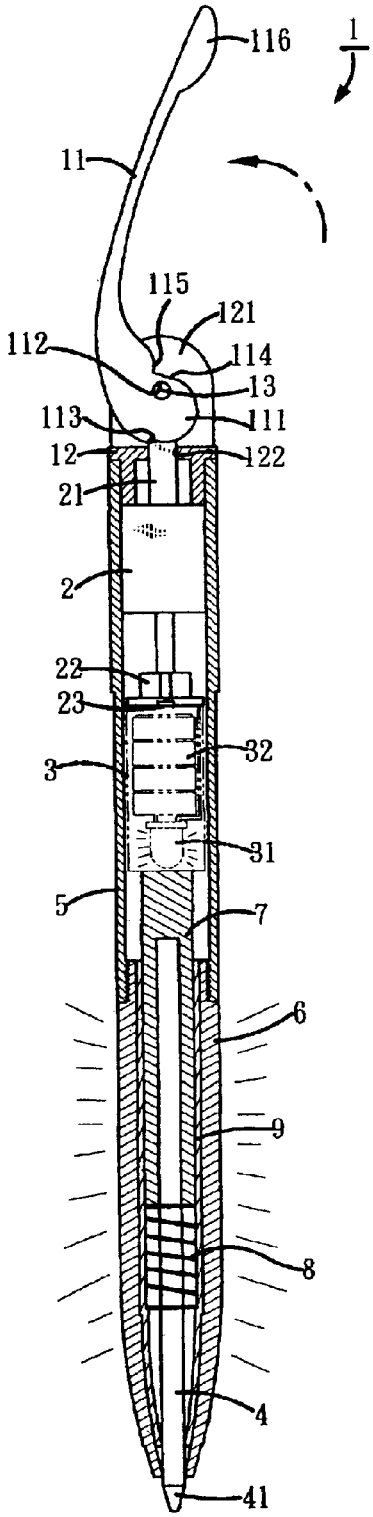
FIG. 6 shows the operation of the clip according to the present invention.

With reference to FIG. 6, when the clip 11 rotates around the eccentric axial hole 112, the eccentric block 111 will press the switch button 2 so that the clutch shaft 22 at the lower end of the switch button 2 presses a top surface of the light emitting device 3 to conduct and thus the light emitting body 31 lights up. Light radiates out from the transparent cylinder 6. An upper side of the light emitting device 3 is pressed by the switch button 2 to move downwards. Thereby, the conduit 7 and the refill 4 below the light emitting device 3 will move downwards and thus the tip 41 of the refill 4 protrudes out of the cylinder 6.

When the clip 11 rotates upwards to an orientation which cause the light emitting device 3 and the tip 41 protrude out, the recess 113 of the eccentric block 111 will buckle a top edge of the top stud 21 of the switch button 2 so as to prevent the clip 11 to move over a desired extend. Moreover, in this orientation, the elastic forces from conductive spring 23 below the switch button 2 and resilient spring 8 and the force from the user can not to resilient the clip 11. Thereby, it is unnecessary to worry about that the clip 11 will return so that the tip 41 is embedded into the cylinder 6.

When fingers move the clip 11 downwards slightly so that the cambered portion of the eccentric block 111 is over one half (about returns through 60 degrees), the clip 11 rapidly returns by the actions of the springs 23 and 8.

Advantages of the present invention will be described here. Before moving the clip, the clip can be preferred clamping force by the springs in the switch button and below the refill. When the clip rotates upwards, the light emitting pen actuated by pivotally rotating a clip lights up and light radiates from the lower pen tube so that the user can use the pen at night. The operation is easy and the user can only use only thumb to rotate the clip so as to control the protrusion action of the light emitting body and tip of the refill. Moreover, when the clip is pressed downwards, the light emitting body will not light up and the tip embeds into the pen tube.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A light emitting pen actuated by pivotally rotating a clip comprising an upper pen tube and a lower pen tube, the upper pen tube including a pen tube, a switch button in the pen tube, a light emitting device in the pen tube and below the switch button; and the lower pen tube including cylinder, a refill in the cylinder, a conduit resisting against a bottom of the light emitting device for receiving the refill; and a resilient spring enclosing the refill;

wherein a base is at an upper end of the upper pen tube; the base has a slot; an end portion of the clip is buckled into the slot; the end portion of the clip is an eccentric block; the eccentric block is pivotally installed in the slot by using a stud; a top stud of the switch button protrudes from a central round hole of the base; a top of the top stud resists against the eccentric block of the clip; when the clip pivotally rotates upwards, the eccentric block presses the top stud so that the switch button descends to contact the light emitting device to cause a light emitting body in the light emitting device lights up; then, the light emitting device moves downwards to cause the refill to move downwards; then a pen tip of the refill protrudes out of the pen tube; when the clip pivotally rotates, the light emitting body does not light up and the tip embeds into the pen tube.

2. The light emitting pen actuated by pivotally rotating a clip as claimed in claim 1, wherein the clip is a cambered arm; one end of the clip is the eccentric block and another end of the clip is an ear portion resisting against an outer wall of the upper pen tube.

3. The light emitting pen actuated by pivotally rotating a clip as claimed in claim 1, wherein an upper end of the eccentric block has a trapezoidal recess for buckling an top edge of the top stud of the switch button to prevent the clip from over-rotation.

4. The light emitting pen actuated by pivotally rotating a clip as claimed in claim 1, wherein a lower end of the eccentric block has a flat surface and a cambered stop wall which is connected to the flat surface; the flat surface and the stop wall are formed as a triangular recess in an inner wall of the pen tube for resisting against the top stud of the switch button so as to retain the clamping force of the clip.

5. The light emitting pen actuated by pivotally rotating a clip as claimed in claim 1, wherein the refill is integrally formed with the conduit.

6. The light emitting pen actuated by pivotally rotating a clip as claimed in claim 1, wherein the refill of the lower pen tube is added with a liner tube; the refill, conduit, and resilient spring are placed in the liner tube.

* * * * *